US008178785B2

(12) United States Patent
Grögl et al.

(10) Patent No.: US 8,178,785 B2
(45) Date of Patent: May 15, 2012

(54) FLEXIBLE ELECTRIC CABLE

(75) Inventors: Ferdinand Grögl, Nürnberg (DE); Thomas Mann, Weiβenohe (DE)

(73) Assignee: Nexans, Paris (FR)

( * ) Notice: Subject to any disclaimer, the term of this patent is extended or adjusted under 35 U.S.C. 154(b) by 285 days.

(21) Appl. No.: 12/581,248

(22) Filed: Oct. 19, 2009

(65) Prior Publication Data

US 2011/0088926 A1 Apr. 21, 2011

(51) Int. Cl.
*H01B 9/02* (2006.01)

(52) U.S. Cl. ..... 174/106 R; 174/113 R

(58) Field of Classification Search ..... 174/106 R, 174/107, 113 R

See application file for complete search history.

(56) References Cited

U.S. PATENT DOCUMENTS 6,064,000 A * 5/2000 Kim ..... 174/36
6,563,052 B2 * 5/2003 Groegl et al. ..... 174/106 R
7,038,138 B2 * 5/2006 Laity et al. ..... 174/113 R
7,432,446 B2 * 10/2008 Orfin et al. ..... 174/113 R
2009/0056972 A1 * 3/2009 Dlugas et al. ..... 174/107

FOREIGN PATENT DOCUMENTS

DE 10162739 7/2003
EP 1589541 10/2005

* cited by examiner

*Primary Examiner* — Chau Nguyen
(74) *Attorney, Agent, or Firm* — Sofer & Haroun, LLP

(57) ABSTRACT

An electrical line for the connection of non-stationary electrical loads to a power source is specified which has a line core surrounded by a jacket (8) of insulating material. Four wires (1), stranded together to form one star quad (S), for the transmission of data, and also two wires (2) stranded together to form a pair of wires (A) and used for supplying power are placed in the line core. The star quad (S) and the pair of wires (A) are stranded together as stranding elements for forming the line core and, over the same, a layer (5) of insulating material is placed, over which a braid or a stranded cover layer of copper wires is arranged in a first layer (6) as part of an electrical screen. At least one layer of a fleece material consisting of synthetic material and made electrically conductive is placed over the first layer (6) as second layer (7) of the electrical screen and the fleece material is surrounded by the jacket (8) of insulating material.

5 Claims, 1 Drawing Sheet

FLEXIBLE ELECTRIC CABLE

BACKGROUND

1. Field of the Invention

The invention relates to an electrical line for the connection of non-stationary electrical loads to a power source, which line has a line core surrounded by a jacket of insulating material, in which line core wires consisting of insulated electrical conductors used both for the transmission of data and for supplying power are arranged and in which the line core is surrounded by an electrical screen having two layers, one of which is constructed as braid or stranded cover layer of copper wires and the other one of which is constructed of a fleece material consisting of synthetic material made electrically conductive.

Such a line is disclosed in EP-A-1 589 541.

2. Description of Related Art

Such lines are used, for example, in drag chains and for connecting non-stationary devices, particularly robots, to a voltage or signal source. The lines must be capable of carrying mechanical loads, with a flexural strength which remains uniform for a long time. They should also remain easily bendable within a wide range of temperatures which is, for example, between −40° C. and +80° C. Apart from resistance against temperature and torsion, their electrical properties are of special significance for such lines. This refers especially to the conductors provided for the transmission of data, with operating frequencies of over 100 MHz.

Apart from other transmission elements, the known line according to DE 101 62 739 A1 has two data transmission lines and one power line used for supplying power which are in each case surrounded by an electrical screen. The data transmission lines in each case consist of a pair of wires with two insulated electrical conductors and the power line has four wires of insulated electrical conductors. This known line has been successful in practice. However, its production is complex.

In EP-A-1 589 541 mentioned initially, an electrical line for the connection of non-stationary electrical loads to a power source is described which has a line core surrounded by a jacket of insulating material, in which line core wires consisting of insulated electrical conductors are arranged which are used both for the transmission of data and for supplying power. The line core of this known line is surrounded by an electrical screen having two layers, one of which is constructed as braid or stranded cover layer of copper wires whilst the other one has at least one layer of a fleece material consisting of synthetic material and made electrically conductive. For the data transmission, a pair of wires which is surrounded by shielding is placed in the line core. In the mutually opposite interstices between the wires of the pair of wires, a supply wire each used for supplying power is arranged outside the shielding.

OBJECTS AND SUMMARY

The invention is based on the object of specifying a line of the type described initially which can be produced in a more compact and simple manner and is suitable for transmitting data with operating frequencies of over 100 MHz.

According to the invention, this object is achieved in that four wires, stranded together to form one star quad, for the transmission of data are arranged in the line core, in that at least two wires used for supplying power are also placed in the line core, in that the star quad and the wires used for supplying power are stranded together as stranding elements for forming the line core, in that, over the line core, a layer of insulating material is placed, over which a braid or a stranded cover layer of copper wires is arranged in a first layer as part of the electrical screen, in that the fleece material consisting of synthetic material and made electrically conductive is placed in at least one layer over the first layer as second layer of the electrical screen, and in that the fleece material is surrounded by the jacket of insulating material.

This line can be produced in a simple manner in conventional technology. In the line core, it consists of four wires, stranded together to form one star quad, for the data transmission and of at least two wires for supplying power which are stranded together in a preferred embodiment. The star quad is a symmetric structure of two pairs of wires all of which have the same length. Differences in delay for the data on the two pairs can be eliminated and crosstalk between the two transmission circuits is minimized by the good electrical decoupling of the two pairs given by the symmetry of the star quad. The dimensions of the star quad are also kept small because it does not have its own external electrical screen, also called element screen. This also applies to the wires used for supplying power. Because of the lacking element screens, the star quad and the wires used for supplying power can also be simply stranded together. The layer of insulating material, preferably a fleece material of polypropylene, provides a sufficiently low capacity between the screen and the line core. The braid or the stranded cover layer of copper wires as one layer of the screen produces an optimized line attenuation. As further layer of the screen, the metallized fleece material, which forms a layer of electrically conductive material closed all around, provides the electrical shielding against high-frequency electromagnetic fields over a wide range of frequencies. The metal existing in the fleece material, which is preferably copper, is deposited from the vapour phase. It is deposited not only on the outer surface of the fleece material but also penetrates it and encloses its inner fibres which are held together unsorted in the fleece material as is known. Accordingly, the fleece material is coated in a "penetrating" manner. As a result, it has a metal layer which, although it is porous, is still almost complete and results in a covering of the enclosed line core with electrically effective metallic material of >85%. To form a corrosion or oxidation protection layer, nickel or silver, for example, can be deposited in addition to the copper.

BRIEF DESCRIPTION OF THE DRAWINGS

Exemplary embodiments of the subject matter of the invention are represented in the drawings, in which.

DETAILED DESCRIPTION

Figure 1:
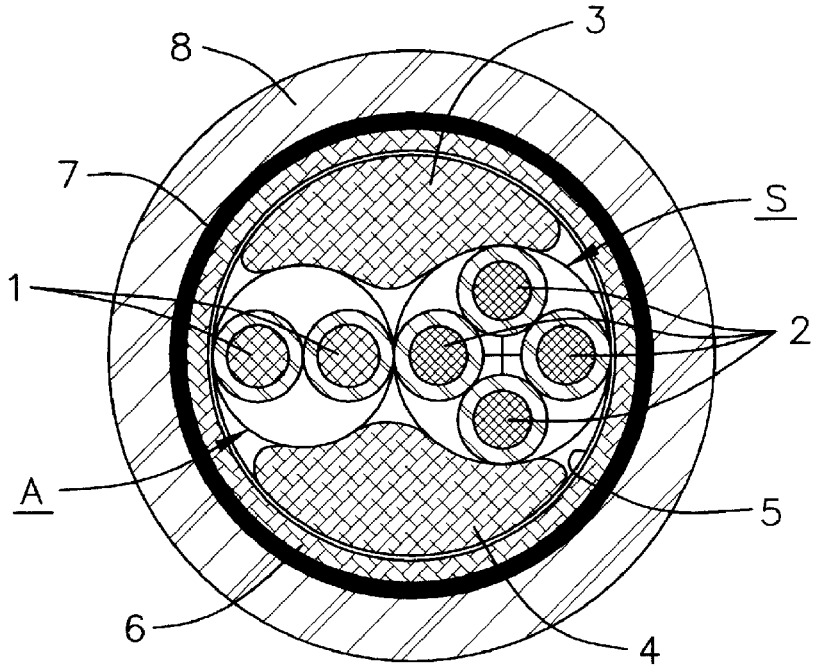
FIG. 1 shows a cross section through a line according to the invention.

In the drawings, a preferred embodiment of the line is shown in which two wires used for supplying power are stranded together to form one pair of wires. The line should have at least two wires used for supplying power which are stranded together with a star quad which is also present in the line core. In the description following, the line is described for the preferred embodiment—also representative of the other possible embodiments.

The line according to FIG. 1 consists of a pair of wires A used for supplying power and a star quad S used for the data transmission. In the pair of wires A, two wires 1 consisting of an insulated electrical conductor are stranded together. The twist length of stranding of the pair of wires A is advantageously within a range of 8×D1 to 14×D1, with the diameter D1 of the pair of wires in mm. The star quad S has four wires 2 stranded together which in each case consist of an insulated conductor. The twist length of stranding of the star quad S is advantageously within a range of between 5×D2 and 8×D2, with the diameter D2 of the star quad in mm. Pair of wires A and star quad S are stranded together. Together with two filling elements 3 and 4 of synthetic material, they form the line core of the line. The filling elements 3 and 4 preferably consist of polypropylene fibres or of low-density polytetrafluoroethylene (PTFE). The stranding of the pair of wires A and the star quad S to form the line core is preferably effected in the opposite direction to the direction of stranding of the wires 1 of the pair of wires A, on the one hand, and of the wires 2 of the star quad S, on the other hand. The twist length of stranding is advantageously within a range of 6×D3 to 14×D3, with the diameter D3 of the line core in mm.

Over the line core, a layer 5 of insulating material is placed which is surrounded by an electrical screen. The screen has a first layer 6 resting against the layer 5, which layer 6 is preferably constructed as braid or stranded cover layer of copper wires. Over the first layer 6 of the screen, a second layer 7 of the latter is arranged which consists of fleece material made electrically conductive. An outer jacket 8 of insulating material surrounds the second layer 7 of the screen.

The conductors of the wires 2 of the star quad S are preferably constructed as stranded conductors consisting of seven copper wires, with a cross section of, for example, 0.25 $mm^2$. To enlarge the electrically conductive cross section of these conductors, six thinner copper wires can be arranged additionally in the outer interstices of the wires. This may lead to a further reduction in the line attenuation. The wires of the stranded conductor can also consist of a copper alloy such as, for example, a copper/tin alloy. To maintain a predetermined diameter of, for example, 1.05 mm at a maximum for the wires 2, the insulation of the conductors consists of solid material to be extruded dimensionally accurately, especially of polyethylene (PE), polypropylene (PP) or of a fluoropolymer (FEP, PTFE, PFA) if the line is to be used in regions with high temperatures.

The star quad S is produced in conventional technology by stranding four wires 2, preferably by reversing the wires so that a twist-free star quad with dimensionally accurately positioned wires is produced.

The conductors of the wires 1 of the pair of wires A provided for supplying power have, for example, a cross section of 0.38 $mm^2$. The diameter of the wires 1 can also be, for example, 1.05 mm at a maximum.

The layer 5 of insulating material advantageously consists of a PP fleece material, of a foamed PP or also of a low-density PTFE if the line is to be used at high temperatures. A ribbon of such a material can be preferably wound with overlap around the line core. In a modified embodiment, the layer 5 can also be constructed as a so-called inner sheath which also fills up the interstices between the star quad S and the pair of wires A. The separate filling elements 3 and 4 are then omitted.

The copper wires of the braid or of the stranded cover layer, respectively, can be tin-plated. When the line is used at higher temperatures, silver- or nickel-plated copper wires can also be used.

In a preferred embodiment, the fleece material of the second layer 7 of the screen is a polyester. Especially at higher operating temperatures, it can also consist of other suitable synthetic materials such as, for example, aramide or glass fibres. Its wall thickness is preferably between 80 μm and 300 μm. For its metallization, at least one electrically highly conductive metal is used, especially copper or silver. A copper layer produced in this way can be provided with an additional nickel layer. The respective metal is deposited on the fleece material from the vapour phase by means of plasma technology.

In this process, the metal vapours also penetrate into the relatively open fibre structure of the fleece material and enclose the fibres held together unsorted, which are located there. Overall, a metal layer which, although it is porous, is almost closed is generated on and in the fleece material which results in a covering of >85% for an enclosed object—in this case it is the first layer 6 of the screen. The fleece material is preferably wound as a ribbon with overlap around the first layer 6 of the screen.

The jacket 8 consists, for example, of polyvinyl chloride, polyurethane, a thermoplastic elastomer, of silicone or of a fluoroelastomer.

The line according to FIG. 1 is suitable, for example, for being used in drag chains in which it is essentially stretched for flexure. A line which, for example, is intended to be used with robots can be seen in FIG. 2. Such a line is stressed not only for flexure but also for torsion. The line core of the line according to FIG. 2, including the layer 5 of insulating material surrounding it, corresponds to that according to FIG. 1.

Figure 2:
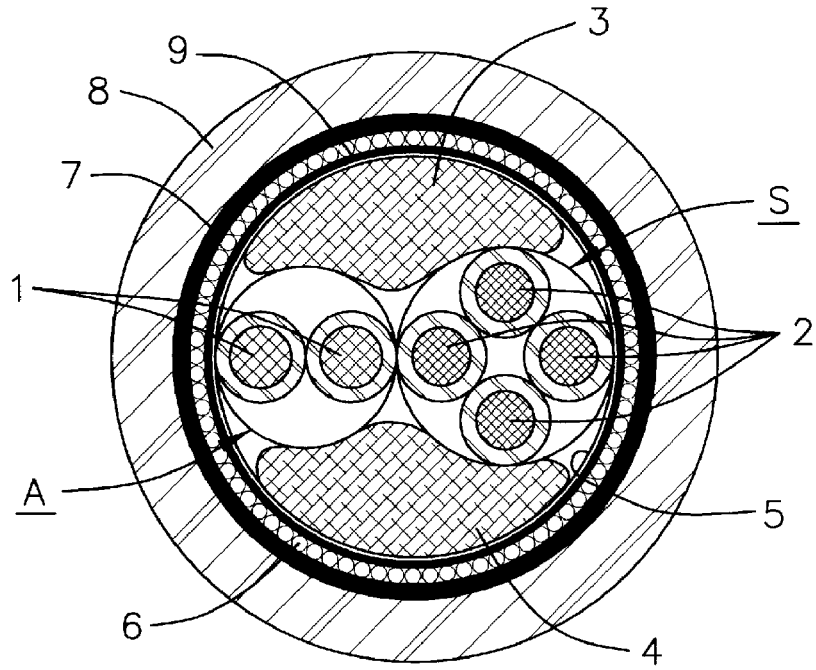
FIG. 2 shows a cross section through a second embodiment of the line.

In the embodiment of the line according to FIG. 2, the electrical screen additionally has an inner layer 9 of two metal-clad foils of synthetic material which can have a metal layer on one side or on both sides. The two foils are advantageously wound around the layer 5 in each case with a gap. In this arrangement, the foil lying on the outside preferably covers the gaps of the foil lying on the inside. The foils in each case consist, for example, of polyester, polyimide or PEEK with a coating of copper or aluminium on one side or on both sides. Over the inner layer 9 of the screen, its first layer 6 is placed which is then constructed advantageously as stranded cover layer of tin-, silver- or nickel-plated copper wires. In this embodiment of the line, the second layer 7 of the screen can also consist of two ribbons of the metallized fleece material explained above which are wound onto the first layer 6 with a gap. The ribbon lying on the outside then covers the gaps of the ribbon lying on the inside.

The invention claimed is:

1. Electrical line for the connection of non-stationary electrical loads to a power source, said electrical line comprising:

a line core surrounded by a jacket of insulating material, in which line core wires made of insulated electrical conductors used both for the transmission of data and for supplying power are arranged and in which the line core is surrounded by an electrical screen having two layers, one of which is constructed as braid or stranded cover layer of copper wires and the other one of which is constructed of a fleece material consisting of synthetic material made electrically conductive, wherein four wires of said line core wires, stranded together to form one star quad, for the transmission of data are arranged in the line core, at least two wires of said line core wires used for supplying power are also placed in the line core, the star quad and the wires used for supplying power are stranded together as stranding elements for forming the line core, over the line core, a layer of insulating material is placed, over said layer of insulating material, a braid or stranded cover layer of copper wires is arranged as a first layer as part of the electrical screen, the fleece material consisting of synthetic material and made electrically conductive is placed in at least one layer over the first layer as a second layer of the electrical screen, and the fleece material is surrounded by the jacket of insulating material.

2. Electrical line according to claim 1, wherein said two wires used for supplying power are provided which are stranded together to form one pair of wires, and the star quad and the pair of wires are stranded together.

3. Electrical line according to claim 1, wherein the layer of insulating material consists of a material based on polypropylene or of a low-density polytetrafluoroethylene.

4. Electrical line according to claim 1, wherein said inner first layer of said electrical screen includes an additional inner part composed of two metal-clad foils of synthetic material which have a metal layer on one side or on both sides are wound, in each case, with a gap over the layer of insulating material, the outer foil covering the gaps of the inner foil over which the first layer of the screen is placed.

5. Electrical line according to claim 4, wherein said first layer as part of the electrical screen is constructed as stranded cover layer.

* * * * *